US009146068B2

(12) United States Patent
Hodgson

(10) Patent No.: US 9,146,068 B2
(45) Date of Patent: Sep. 29, 2015

(54) MOTORIZED WEAPON GYROSCOPIC STABILIZER

(71) Applicant: Dale Albert Hodgson, Chardon, OH (US)

(72) Inventor: Dale Albert Hodgson, Chardon, OH (US)

( * ) Notice: Subject to any disclaimer, the term of this patent is extended or adjusted under 35 U.S.C. 154(b) by 303 days.

(21) Appl. No.: 13/738,186

(22) Filed: Jan. 10, 2013

(65) Prior Publication Data

US 2015/0241161 A1 Aug. 27, 2015

Related U.S. Application Data

(60) Provisional application No. 61/585,267, filed on Jan. 11, 2012.

(51) Int. Cl.

| | |
|---|---|
| ***F41G 5/16*** | (2006.01) |
| ***F41A 21/36*** | (2006.01) |
| ***F41A 27/30*** | (2006.01) |
| ***F41G 5/00*** | (2006.01) |
| ***F41A 21/30*** | (2006.01) |
| ***F41G 1/32*** | (2006.01) |

(52) U.S. Cl.

CPC ..... *F41A 27/30* (2013.01); *F41A 21/30* (2013.01); *F41A 21/36* (2013.01); *F41G 1/32* (2013.01); *F41G 5/00* (2013.01)

(58) Field of Classification Search

CPC ..... F41G 5/16; F41C 27/22; F41A 21/36; F41A 27/30

USPC ..... 89/202, 41.09, 41.04, 41.02, 40.01, 89/41.01, 203; 42/1.06, 97; 74/5 R, 5.1, 74/5.7, 5.9

See application file for complete search history.

(56) References Cited

U.S. PATENT DOCUMENTS

| | | | | |
|---|---|---|---|---|
| 464,806 | A | 12/1891 | Tower | |
| 640,051 | A | 12/1899 | Tower | |
| 1,573,028 | A * | 2/1926 | Bates | 74/5.22 |
| 2,106,998 | A | 2/1938 | Fieux | |
| 2,356,189 | A * | 8/1944 | Tufts | 89/202 |
| 2,405,052 | A * | 7/1946 | Poitras et al. | 89/202 |
| 2,472,944 | A | 6/1949 | Furer et al. | |
| 2,532,333 | A * | 12/1950 | Smith | 89/41.09 |
| 2,534,225 | A | 12/1950 | Brown | |
| 2,609,606 | A | 9/1952 | Draper et al. | |
| 2,679,192 | A | 5/1954 | Seeley et al. | |
| 2,845,737 | A | 8/1958 | Hoyer | |
| 2,938,435 | A | 5/1960 | Gille | |
| 3,034,116 | A * | 5/1962 | Shelley | 342/67 |
| 3,078,728 | A * | 2/1963 | Schlesman | 74/5.7 |
| 3,144,644 | A | 8/1964 | Getting | |

(Continued)

OTHER PUBLICATIONS

International Search Report and Written Opinion, dated Dec. 9, 2014 in connection with PCT/US14/11062, filed Jan. 10, 2014.

*Primary Examiner* — Reginald Tillman, Jr.

(74) *Attorney, Agent, or Firm* — Fay Sharpe LLP

(57) ABSTRACT

A motorized weapon gyroscopic stabilizer which creates a stabilizing effect for single shot, semi-automatic, and fully automatic weapons. The rotating mass that generates the gyroscopic stabilizing effect is the rotor of the motor. The motor is designed to allow the mass to rotate around the open core of the motorized weapon gyroscopic stabilizer. Because of its open core design the motorized weapon gyroscopic stabilizer allows the fired projectile to pass through it, or be mounted in line with the sighting mechanism allowing the target alignment—line of sight to pass through the motorized weapon gyroscopic stabilizer, or both.

18 Claims, 4 Drawing Sheets

(56) References Cited

U.S. PATENT DOCUMENTS

| | | | | | |
|---|---|---|---|---|---|
| 3,165,972 | A | | 1/1965 | Cumbo | |
| 3,362,073 | A | | 1/1968 | Hausenblas et al. | |
| 3,396,630 | A | | 8/1968 | Hinterthur et al. | |
| 3,424,522 | A | | 1/1969 | Call | |
| 3,489,057 | A | | 1/1970 | Tonkin | |
| 3,502,062 | A | * | 3/1970 | Shurts | 124/23.1 |
| 3,640,178 | A | | 2/1972 | Chatham et al. | |
| 3,664,199 | A | * | 5/1972 | Lahde | 74/5.6 D |
| 3,913,870 | A | | 10/1975 | Bolick | |
| 4,297,905 | A | | 11/1981 | Hadekel | |
| 4,307,653 | A | | 12/1981 | Goes et al. | |
| 4,476,969 | A | | 10/1984 | Dykema | |
| 4,621,266 | A | * | 11/1986 | Le Gall et al. | 342/359 |
| 4,974,493 | A | | 12/1990 | Yeffman | |
| 5,113,745 | A | | 5/1992 | Allen | |
| 5,339,789 | A | | 8/1994 | Heitz | |
| 6,227,098 | B1 | | 5/2001 | Mason | |
| 6,941,851 | B2 | | 9/2005 | Urvoy | |
| 7,870,814 | B2 | | 1/2011 | Lounsbury | |
| 8,028,611 | B2 | | 10/2011 | Loundsbury | |
| 8,220,448 | B1 | * | 7/2012 | Moggo | 124/89 |
| 2011/0275435 | A1 | | 11/2011 | Torre | |
| 2012/0030984 | A1 | | 2/2012 | Andersson | |

* cited by examiner

MOTORIZED WEAPON GYROSCOPIC STABILIZER

The present application relates to weapon stabilizer systems. It finds particular application in utilizing a motorized weapon gyroscopic stabilizer to create a stabilizing effect for single shot, semi-automatic, and fully automatic weapons, and will be described with particular reference thereto. It is to be understood, however, that it also finds application in other devices, and is not necessarily limited to the aforementioned application.

Shooting a weapon depends on a high degree of precision. Slight movements made by the shooter significantly alter the accuracy of the shot. This variation in target alignment is made even more significant when compounded over long distances. Over time, shooters have been taught to minimize these movements by using a variety of methods to create stability and support of the weapon during target alignment and firing of the weapon. This desired stability of the target alignment is so critical that a shooter is taught to measure his breaths, and be aware of his heartbeats as he prepares for his shot. A small fraction of a degree in target misalignment when magnified over a long distance is enough to miss the target.

While there are a variety of sights, scopes, and aiming devices available for weapons, they only serve to make the shooter more aware of the existing deviations experienced during aiming and firing at his target. Typically, the shooter has the ability to support his weapon from the middle and/or rear with handgrips, and/or stock supports. When possible, a shooter enhances his stability by supporting the weapon with external stable surfaces available to him in his environment at the time. Unfortunately, due to the different conditions and environments in which a weapon is expected to function, the ideal support for the weapon is not always available. Without the aid of external stable surfaces for the weapon, the shooter is dependent on supporting the unsupported weapon with his skeletal structure incorporated into their position, and the steadiness of their muscles.

With a weapon, during the first shot, the shooter typically experiences recoil from the shot. During this recoil phase, the weapon typically moves as the projectile is fired and propelled and leaves the weapon. Typically, this recoil affects the least supported part of the weapon the most. This recoil causes alignment with the target to be altered, and requires subsequent shots to be made after adjusting target alignment, causing a delay in repeated firing and the ability to aim accurately. The less the natural recoil of the weapon affects the target alignment, the faster the target can be reacquired, and subsequent shots may be made. This recoil problem is present with single shot, semi-automatic, and fully automatic weapons.

Gyroscopes have been utilized in the past in a wide variety of stabilizing applications, but size, weight, and bulk have limited their application related to the handheld weapon field. Gyroscopes are heavy and cumbersome, and while used for applications such as on cameras, missiles, battleship guns, and tanks, they have never been practically used on handheld weapons.

The present application provides a weapon stabilizer system and apparatus which overcomes the above-referenced problems and others.

In accordance with one aspect, a motorized weapon gyroscopic stabilizer system is provided. The system includes a housing including an open core rigidly mounted to a barrel of a weapon. An electronic motor includes a rotor configured to provide gyroscopic stability, the rotor surrounding the open core and including an axis of rotation and a mass element configured to rotate around the axis of rotation.

The motorized weapon gyroscopic stabilizer improves the stability of a weapon during single shots, semi-automatic shots, and fully automatic shots through the use of a lightweight high speed integral brushless motor driven gyroscopic stabilization device. The device relies on the three primary variables involved in creating gyroscopic stability; the mass of the spinning element, the speed of the spinning element, and the diameter of the spinning element. By altering any of these three variables, the gyroscopic stability is altered. However, emphasis may be placed on any of these three variables to overcome the limitations applied to any of the other variables.

To accomplish gyroscopic stability, the motorized weapon gyroscopic stabilizer utilizes a relatively small diameter, low mass, high speed brushless motor driven gyroscope created with integral construction to the weapon, designed to spin on an axis parallel to the weapons direction of fire and/or target alignment method/device. The motorized weapon gyroscopic stabilizer also utilizes a method to increase the speed of the spinning mass to produce extremely high revolutions per minute allowing the device to lower the mass of the spinning mass element while achieving the same gyroscopic stability, thus making the device lighter.

The motorized weapon gyroscopic stabilizer is also designed to be quieter by eliminating traditional electric DC motor construction which requires an electric motor, drive trains and independent gyroscopic spinning mass elements, all of which produce noise. Instead, the device is designed to create its gyroscopic stability through the natural construction of a brushless motor and the spinning mass of its rotor. The brushless motor is designed to spin on an axis parallel to the weapons direction of fire and/or target alignment method/device. Also, because the brushless motor does not utilize traditional electric motor brushes, it eliminates the noise created from the friction of brushes contacting the stator.

The motorized weapon gyroscopic stabilizer is also designed to minimize bulk by integrating the gyroscope into the weapons natural structure emphasizing its attachment in line with the axis parallel to the weapons direction of fire and/or target alignment method/device. The device has a small rotational mass diameter and compensates for this through its high speed rotation. The diameter of the spinning mass element is critical to the function of a gyroscope. Increasing the diameter, increases the gyroscopic stability it generates. The brushless motor eliminates the need to create a separate motor which would require additional gears, pulleys, or drive train mechanisms required to transfer rotation to a gyros secondary diameter of mass, all of which adds to a devices bulk. The motorized gyroscopic weapon stabilizer is designed with a hollow rotational axis which allows it to share space with other functional elements incorporated into all weapons, such as, but not limited to; by way of example in a firearm type weapon; its barrel, its axis parallel to the weapons direction of fire, and/or with the target alignment-line of sight method/device natural to the firearm.

This sharing of space allows the motorized weapon gyroscopic stabilizer to incorporate with the natural form of the weapon, and prevent the bulk of adding a separate large cylindrical shape, which is essential to create a gyroscopic stabilizer, somewhere else on a weapon. Due to this form, it allows the device to be positioned as far away as practical from the already existing support surfaces on the weapon to maximize the gyroscopic stability it provides.

This motorized weapon gyroscopic stabilizer is designed to be either rigidly attached or be made removable from the weapon. The attachment method varies and is dependent on the design and the configuration of the specific weapon, and may be attached either permanently, or temporarily. This is fully capable of being added to, or removed from the weapon, or in being permanently attached or permanently affixed into the weapons structure.

The motorized weapon gyroscopic stabilizer is designed to be either used independently, or incorporated into other devices including but not limited to; barrels, flash suppressors, silencers, noise suppressors, scopes, lasers, optics, holographic sights, target alignment devices, and other devices benefiting from its unique hollow core construction.

Still further advantages of the present invention will be appreciated to those of ordinary skill in the art upon reading and understand the following detailed description.

The invention may take form in various components and arrangements of components, and in various steps and arrangements of steps. The drawings are only for purposes of illustrating the preferred embodiments and are not to be construed as limiting the invention.

Figure 1:
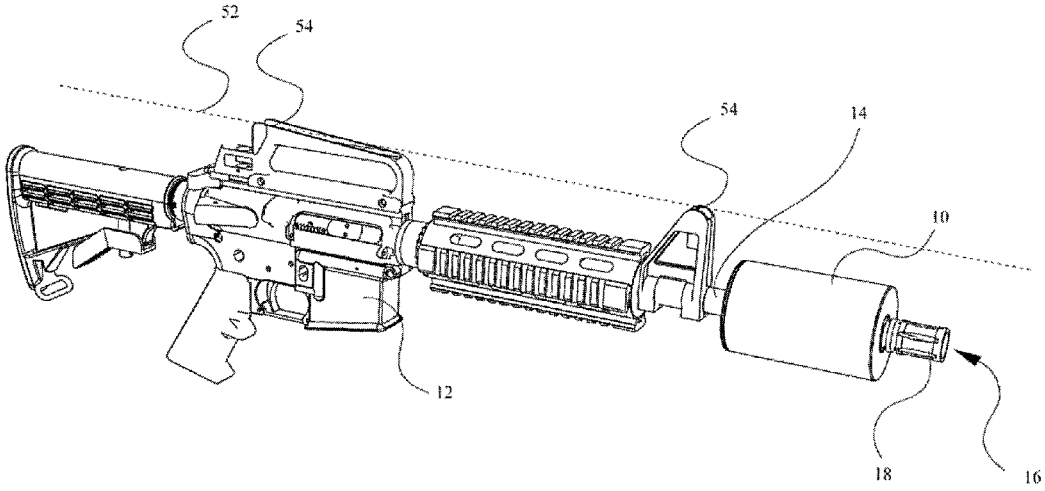
FIG. 1 is an illustration of the motorized weapon gyroscopic stabilizer mounted to a weapon, by way of example the barrel of a firearm.

With reference to FIG. 1, the motorized weapon gyroscopic stabilizer 10 is illustrated by way of example as being mounted onto the barrel 14 of a weapon 12. Such type of weapon 12 include a single shot, semi-automatic, or fully automatic weapon 12 with either single or multiple barrels 14. By way of example, the motorized weapon gyroscopic stabilizer 10 is rigidly attached to the barrel 14 of a rifle type weapon 12. The barrel 14 passes through the motorized weapon gyroscopic stabilizer 10 and is secured by way of example by the attachment of a flash suppressor 18 or other retention method. This method of attachment is only one method of attaching the motorized weapon gyroscopic stabilizer 10 to a weapon 12. Since weapon 12 configurations vary significantly, the attachment method varies according to the weapon 12. The projectile exit 16 of the weapon 12 allows the projectile to pass through the motorized weapon gyroscopic stabilizer 10. The motorized weapon gyroscopic stabilizer 10 is intended to work with single and multiple barrel weapons 12. The motorized weapon gyroscopic stabilizer 10 provides stability to the weapon 12 by the extremely fast rotation of the cylinder of mass around the hollow core of the device. The center of rotation as shown by way of example is aligned with the barrel 14 of the weapon 12 so that the projectile passes through the motorized gyroscopic weapon stabilizer 10. In other configurations, the motorized weapon gyroscopic stabilizer 10 allows the target alignment—line of sight 52 to pass through it, or function having both the target alignment—line of sight 52 and the axis of the projectile exit 16 aligned through the motorized gyroscopic weapon stabilizer 10 allowing the projectile to pass through it as well. The sighting mechanism 54 used on the weapon may vary considerably, which include visual, non-magnified, magnified, optical or other types of sighting mechanisms 54 designed to create target alignment—line of sight 52 function through the open core of this device.

Figure 2:
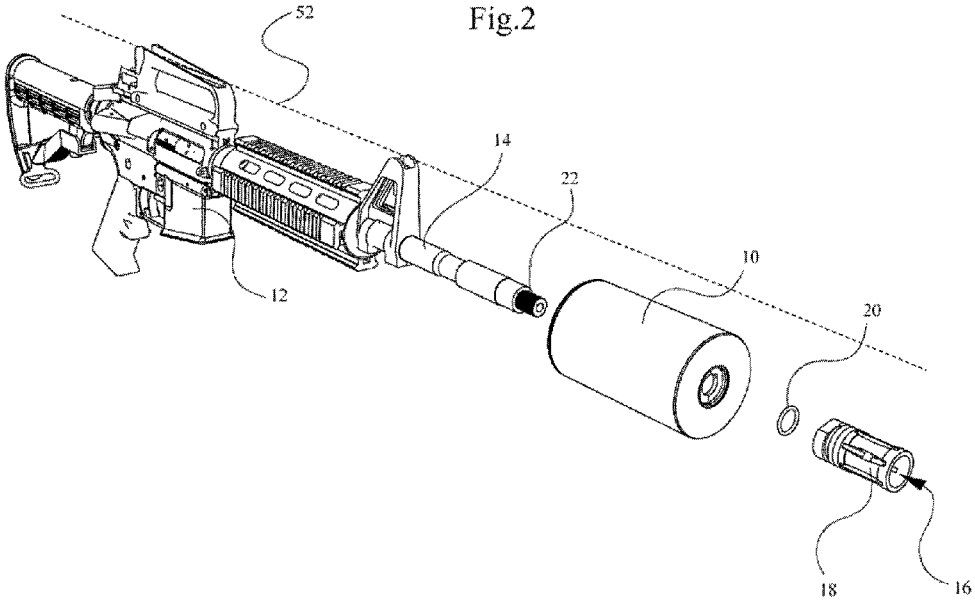
FIG. 2 is an illustration of the motorized weapon gyroscopic stabilizer mounted to a weapon through one of the many ways of attachment by way of example the barrel of a firearm.

In FIG. 2, the motorized weapon gyroscopic stabilizer 10 is mounted to a weapon 12 in another example. As illustrated, the motorized weapon gyroscopic stabilizer 10 is shown by way of example on a rifle type weapon 12 being rigidly attached by using the threaded portion of the barrel 22 of the weapon 12 along with the threaded flash suppressor 18 normal to this type of weapon 12. In other rifle or pistol type weapons 12, the motorized weapon gyroscopic stabilizer 10 is attached onto the barrel 14, or in front of the barrel 14 with different brackets or attachment modifications making it; permanently incorporated into the barrel 14, rigidly fixed to the barrel 14, or temporarily fixed to the barrel 14 depending on the application. The motorized weapon gyroscopic stabilizer 10 is able to be mounted in similar ways to the weapon 12 with the target alignment—line of sight 52 passing through it.

Figure 3:
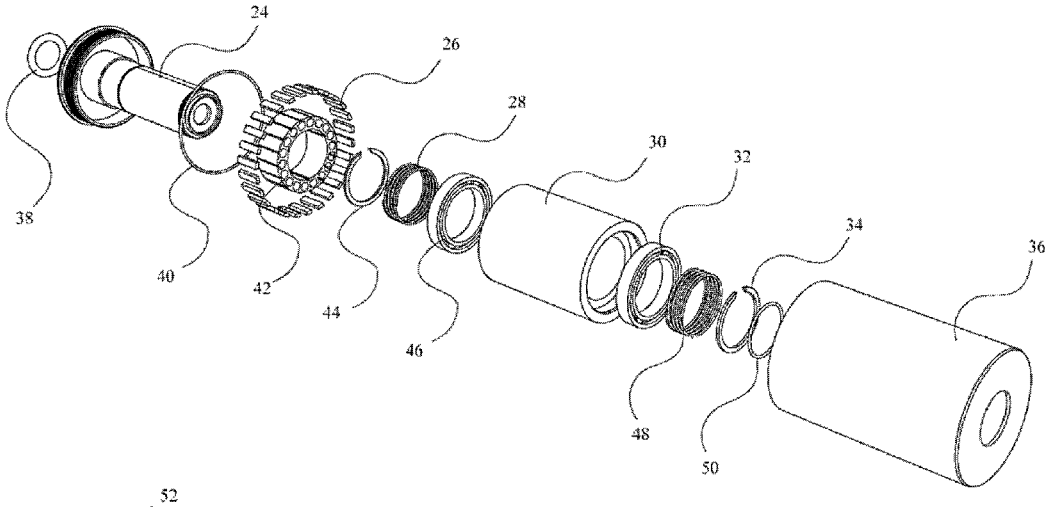
FIG. 3 is an illustration of an exploded view of the motorized weapon gyroscopic stabilizer.

FIG. 3 illustrates the motorized weapon gyroscopic stabilizer 10 in an exploded drawing. The inner housing 24 is designed to create the open core shaft of an brushless motor, allowing it to be mounted to a weapon 12 in variety of ways. The inner housing 24 is rigidly attached to the outer housing 36, making water resistant assembly possible. By way of example, the inner housing 24 is shown as threaded, although there are many different methods to rigidly attach the inner housing 24 to the outer housing 36. The inner housing 24 may be constructed of a wide variety of different materials. The rear ring seal 40 attaches to the inner housing 24 to create the rear portion of the water resistant seal to the elements. An electronic power board houses electronics which powers and controls the motorized gyroscopic weapon stabilizer 10. The electronic power board controls the operation of the brushless motor, and is programmed to provide speeds and start-stop settings for the brushless motor function. The electronic power board can be rigidly attached to the inner housing 24 or located on different locations on the weapon 12. The rear retainer 44 slides over the inner housing 24 and holds the elements in position inside the motorized gyroscopic weapon stabilizer 10. The rear retainer 44 positively engages into a groove in the inner housing 24 for fixed positioning. The magnets 26 are bonded to the inside of the rotor 30. The magnets 26 count and spacing is varied according to the desired speed and torque of the brushless motor. The stator and windings 42 are formed from stacks of electric steel with copper wire windings wound around their poles. The pattern of the stator and windings 42 are varied according to the desired speed and torque of the brushless motor. A middle retainer can slide over the inner housing 24 and hold the elements in position inside the motorized gyroscopic weapon stabilizer 10. The middle retainer can also positively engage into a groove in the inner housing 24 for fixed positioning. The rear bearing 46 slides over the inner housing 24 and is pressed inside the rotor 30. The rear bearing 46 is positively positioned inside the rotor 30 by an internal formed shoulder in the rotor 30. The rear bearing 46 may be several types of construction, including but not limited to a ball, wheel, roller, radial ball, angular contact, tapered roller, spherical roller, cylindrical roller, pillow block, thrust roller, needle roller, or non contact bearing. The bearing materials may be varied and include, but are not limited to; metal, plastic, non ferrous or ceramic construction. The rotor 30 forms the spinning mass of the gyroscopic assembly, and the outside of the brushless motor, and may be constructed of a variety of materials. Traditional brushless motors are designed to make the motor shaft and attached outer rotor housing rotate. This is accomplished by having the inner stator and windings fixed in place. The outer rotor housing with its attached magnets and the attached shaft are designed to rotate freely around the fixed stator. In this motorized gyroscopic weapon stabilizer 10, the inner housing 24 functions as a brushless motor shaft, and the rotor 30 is made to rotate, creating the gyroscopic force. The inner housing 24 in this device does not rotate. The rotor 30 has both front bearing 32 and rear bearing 46 pressed inside of it, and magnets 26 are internally bonded to the inner surface of the rotor 30 which is designed to spin at a significant speed. The front retainer 34 slides over the inner housing 24 and holds the elements in position inside the motorized gyroscopic weapon stabilizer 10. The front retainer 34 positively engages into a groove in the inner housing 24 for fixed positioning. The rear ring seal 40 and the front ring seal 50 are designed to compress between the inner housing 24 and the outer housing 36 to form a water resistant seal, protecting the inner workings of the motorized gyroscopic weapon stabilizer 10 from the elements. The outer housing 36 is rigidly attached to the inner housing 24. The attachment of the inner housing 24 to the outer housing 36 may be made in many different ways, but is illustrated by way of example as a threaded attachment. The outer housing 36 provides protection to the internal elements of the motorized gyroscopic weapon stabilizer 10. The outer housing 36 may be constructed of a wide variety of different materials. The rear spring 28 provides protection of the inner bearings and mechanical elements from the recoil forces generated when firing the weapon. The front spring 48 provides additional protection of the inner bearings and mechanical elements from the recoil forces generated when firing the weapon.

Figure 4:
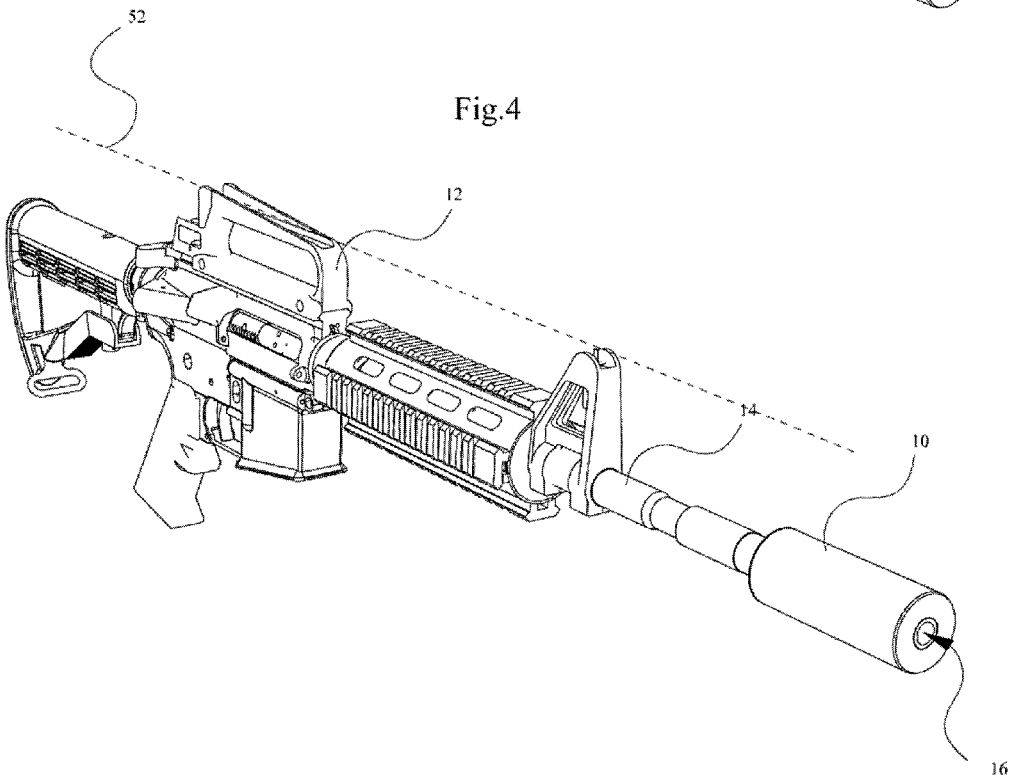
FIG. 4 is an illustration of the motorized weapon gyroscopic stabilizer attached in an alternate by way of example as an extension of the barrel of a firearm.

FIG. 4 illustrates an alternative mounting position of the motorized gyroscopic weapon stabilizer 10 by way of example in front of the barrel 14 of a rifle type weapon 12. In this illustration, the motorized gyroscopic weapon stabilizer 10 is shown mounted in front of the barrel 14, extending the overall length of the weapon 12. Due to the open core design of this device, the motorized gyroscopic weapon stabilizer 10 is configured to perform additional functions by incorporating other barrel 14 related accessories into the design of the device, such as, but not limited to; flash suppressors, muzzle breaks, and or sound suppressors, gas tubes, or anything used in conjunction with the barrel 14 or target alignment—line of sight 52 function of the weapon 12 which would benefit by the open core construction of this device.

Figure 5:
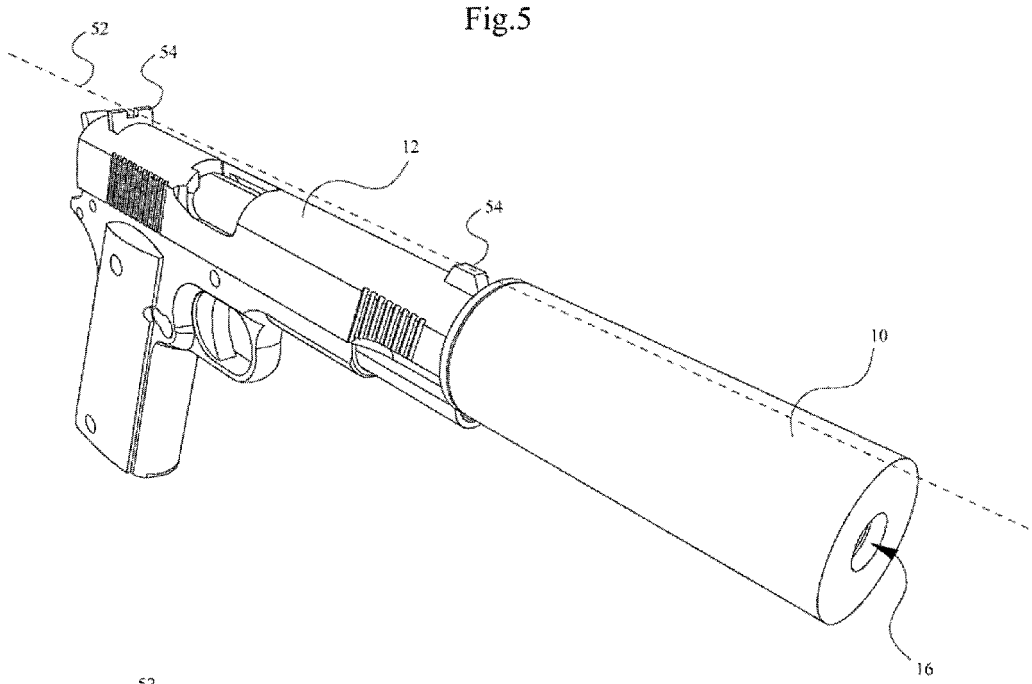
FIG. 5 is an illustration of the motorized weapon gyroscopic stabilizer attached to the barrel of a pistol type firearm.

FIG. 5 illustrates the motorized gyroscopic weapon stabilizer 10 by way of example rigidly attached to a pistol type weapon 12, showing the flexibility of the devices design. Because pistol type weapons 12 vary in configuration significantly, the method of attachment to the pistol type weapon 12 will vary as well. This illustration also shows how the target alignment—line of sight 52 is above the motorized gyroscopic weapon stabilizer 10, while the axis of the projectile exit 16 is aligned through the motorized gyroscopic weapon stabilizer 10 allowing the projectile to pass through it. It is also contemplated that the motorized gyroscopic weapon stabilizer 10 can be mounted to a wide variety of weapons and configured to allow either the target—alignment line of sight 52, or the axis of the projectile exit 16 to pass through the open core in the motorized gyroscopic weapon stabilizer 56, or both simultaneously.

Figure 6:
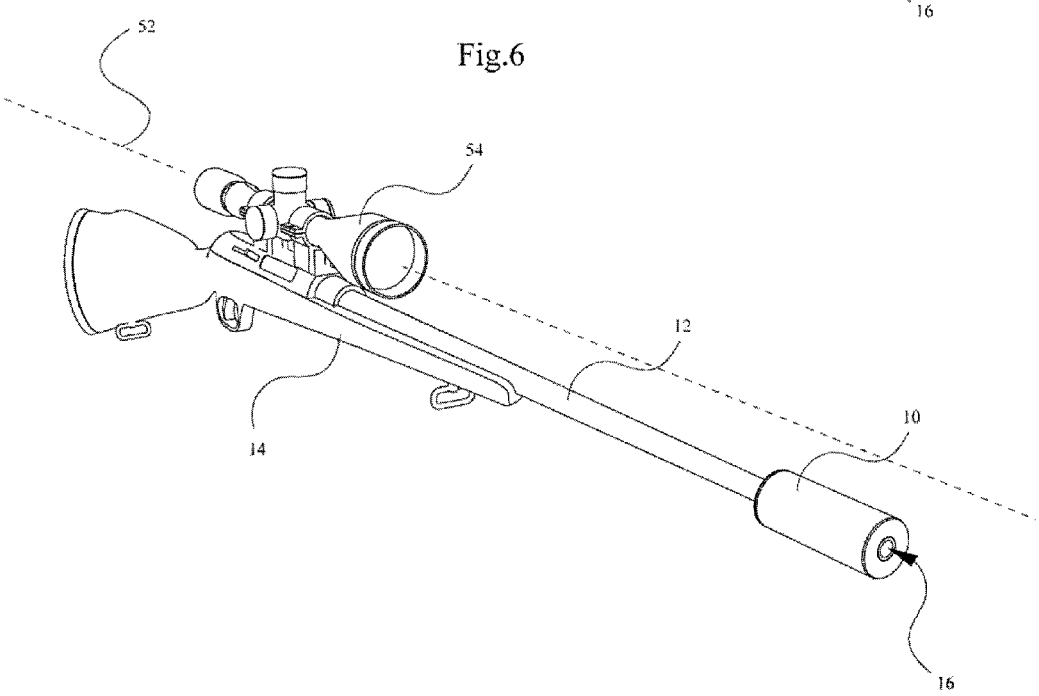
FIG. 6 is an illustration of the motorized weapon gyroscopic stabilizer attached by way of example to the barrel of a rifle type weapon with the projectile passing though the motorized gyroscopic weapon stabilizer, and the target alignment—line of sight not passing through the motorized gyroscopic weapon stabilizer.

FIG. 6 illustrates the motorized gyroscopic weapon stabilizer 10 by way of example rigidly attached to the barrel 14 of a rifle type weapon 12. Because rifle type weapons 12 vary in configuration significantly, the method of attachment to the rifle type weapon 12 will vary as well. In this example, the target alignment—line of sight 52 passes through the sighting mechanism 54 which by way of example and includes, but is not limited to a telescopic type alignment device. By way of example, the target alignment—line of sight 52 in this drawing does not pass through the motorized gyroscopic weapon stabilizer 10, although the motorized gyroscopic weapon stabilizer 10 is attached by way of example to the rifle type weapon 12 barrel 14, allowing the projectile to pass through the open core in the motorized gyroscopic weapon stabilizer 56.

Figure 7:
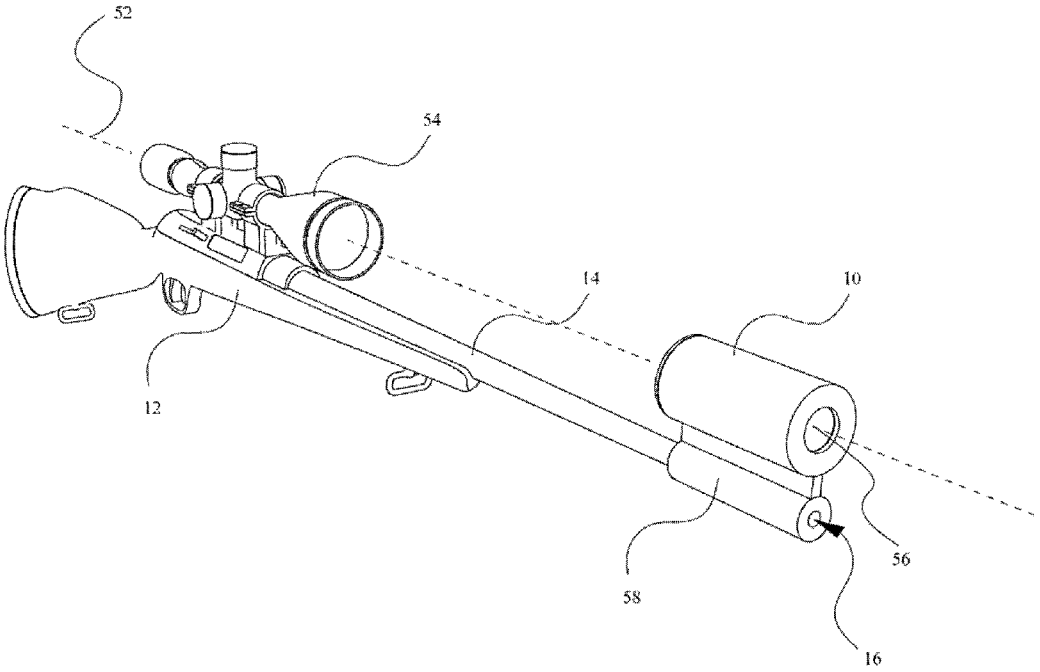
FIG. 7 is an illustration of the motorized weapon gyroscopic stabilizer attached by way of example to a rifle type firearm allowing the target alignment—line of sight to pass through the open core of the motorized gyroscopic weapon stabilizer.

FIG. 7 illustrates the motorized gyroscopic weapon stabilizer 10 as mounted by way of example to a rifle type weapon 12. It is mounted to the barrel 14 of the weapon 12 by a support for the motorized gyroscopic weapon stabilizer 58, allowing the target alignment—line of sight 52 of the sighting mechanism 54 to pass through the opening in the motorized gyroscopic weapon stabilizer 56. In this configuration, the projectile does not pass through the open core of the motorized gyroscopic weapon stabilizer 10, but the target alignment—line of sight 52 does.

The invention has been described with reference to the preferred embodiments. Modifications and alterations may occur to others upon reading and understanding the preceding detailed description. It is intended that the invention be constructed as including all such modifications and alterations insofar as they come within the scope of the appended claims or the equivalents thereof.

Having thus described the preferred embodiments, the invention is now claimed to be:

1. A gyroscopic stabilizer system for weaponry, the system comprising:

a hollow core mass element having a bore extending therethrough mounted by at least one bearing for rotation around an axis of rotation extending through the bore; and a mounting structure configured to mount the mass element and bearings to an associated weapon such that the axis of rotation is parallel to an axis of a trajectory of a fired projectile;

wherein the mounting structure includes a tubular inner housing about which the at least one bearing is supported, the tubular inner housing member extending at least partially into the bore of the hollow core mass element.

2. The system according to claim 1, wherein the mass element is cylindrical and the mounting structure is configured to mount the mass element and at least one bearing for rotation around the trajectory of the fired projectile and/or a line of sight.

3. The system according to claim 1, wherein the mounting structure is configured to mount the mass element and at least one bearing to an accessory which is either permanently affixed or temporarily affixed to the weapon, the accessory including at least one of a flash suppressor, a sighting mechanism, a laser, a muzzle brake, a sound suppressor, a gas tube, or a compensator.

4. The system according to claim 1, further including an electric motor which rotates the mass element around the axis of rotation.

5. The system according to claim 1, wherein the associated weapon includes at least one of a single shot, semi-automatic, or fully automatic weapon.

6. The system according to claim 1, wherein the mounting structure mounts the mass element such that the axis of rotation is parallel to and displaced from the axis of the trajectory of the fired projectile and/or a line of sight.

7. The system according to claim 1, wherein the mounting structure mounts the bearings and the mass element to the end of a barrel of the associated weapon.

8. The system according to claim 1, wherein the mass element is cylindrical to define an interior bore and wherein the mounting structure mounts the mass element and the at least one bearing such that either a projectile passes through the bore of the mass element or a sighting mechanism sights through the bore of the mass element.

9. The system according to claim 1, further comprising an outer housing, the outer housing and inner housing being secured together, wherein the rotating mass is enclosed within the inner housing and the outer housing.

10. The system according to claim 9, wherein the inner housing are sealed together forming a watertight compartment in which the rotating mass is enclosed.

11. The system according to claim 1, wherein the rotating mass comprises a rotor portion of an electric motor.

12. The system according to claim 1, wherein the rotating mass is mounted in at least one of a position spaced longitudinally from a barrel of the associated weapon, coextensive with a barrel of the associated weapon, or surrounding a barrel of the associated weapon with at least a portion of the barrel within the bore of the hollow core mass element.

13. A method for stabilizing a weapon, the method comprising:

mounting a mass element by at least one bearing for rotation around an axis of rotation, the mass element having a bore extending therethrough with the axis of rotation extending through the bore;

mounting the mass element and the at least one bearing to a weapon such that the axis of rotation is parallel to an axis of a trajectory of a fired projectile, with the axis of trajectory passing through the bore; and rotating the mass element around the axis of rotation;

wherein the at least one bearing and the mass element are mounted to the end of a barrel of the weapon.

14. The method according to claim 13, wherein the mass element is cylindrical and the mounting of the mass element and at least one bearing for rotation is around the trajectory of the fired projectile and/or a line of sight.

15. The method according to claim 13, wherein the mounting of the mass element and at least one bearing is to an accessory which is either permanently affixed or temporarily affixed to the weapon, the accessory including at least one of a flash suppressor, a sighting mechanism, a laser, a muzzle brake, a sound suppressor, a gas tube, or a compensator.

16. The method according to claim 13, wherein the weapon includes at least one of a single shot, semi-automatic, or fully automatic weapon.

17. The method according to claim 13, wherein the mass element is mounted such that the axis of rotation is parallel to and displaced from the axis of the trajectory of the fired projectile.

18. A method for stabilizing a weapon, the method comprising:

mounting a mass element by at least one bearing for rotation around an axis of rotation, the mass element having a bore extending therethrough with the axis of rotation extending through the bore;

mounting the mass element and bearings to a weapon such that the axis of rotation is parallel to an axis of a trajectory of a fired projectile, with the axis of trajectory passing through the bore; and rotating the mass element around the axis of rotation;

wherein the mass element is cylindrical to define an interior bore and wherein the mass element and the at least one bearing are mounted such that either a projectile passes through the bore of the mass element or a sighting mechanism sights through the bore of the mass element.

* * * * *